US010753607B2

(12) United States Patent
Beakley et al.

(10) Patent No.: US 10,753,607 B2
(45) Date of Patent: Aug. 25, 2020

(54) APPARATUS AND METHOD FOR SOUND REDUCTION OF HIGH EFFICIENCY FURNACES

(71) Applicant: Lennox Industries Inc., Richardson, TX (US)

(72) Inventors: Leonor Beakley, Plano, TX (US); Leonard J. Cook, Lewisville, TX (US); David Chilson, Lewisville, TX (US)

(73) Assignee: Lennox Industries Inc., Richardson, TX (US)

( * ) Notice: Subject to any disclaimer, the term of this patent is extended or adjusted under 35 U.S.C. 154(b) by 366 days.

(21) Appl. No.: 15/837,364

(22) Filed: Dec. 11, 2017

(65) Prior Publication Data

US 2019/0178493 A1 Jun. 13, 2019

(51) Int. Cl.

| | |
|---|---|
| ***F23M 20/00*** | (2014.01) |
| ***F24D 5/04*** | (2006.01) |
| ***F23J 13/00*** | (2006.01) |

(52) U.S. Cl.

CPC ..... *F23M 20/005* (2015.01); *F23J 13/00* (2013.01); *F24D 5/04* (2013.01); *F23J 2900/13003* (2013.01)

(58) Field of Classification Search

CPC .. F23M 20/005; F24D 5/00; F24D 5/04; F23J 2900/13003; F23J 13/00

See application file for complete search history.

(56) References Cited

U.S. PATENT DOCUMENTS

| | | | | |
|---|---|---|---|---|
| 4,561,421 | A * | 12/1985 | Hwang | F24H 3/065 126/110 R |
| 4,867,673 | A * | 9/1989 | Harrigill | F23D 14/84 431/171 |
| 4,992,043 | A * | 2/1991 | Lockwood, Jr. | F02G 1/02 110/347 |
| 5,322,050 | A * | 6/1994 | Lu | F24H 3/087 126/110 R |
| 5,676,069 | A * | 10/1997 | Hollenbeck | H02K 29/03 110/147 |
| 5,960,787 | A * | 10/1999 | Raleigh | F23J 11/00 110/162 |
| 7,766,731 | B2 * | 8/2010 | Aschenbruck | F23J 13/02 110/184 |
| 8,240,427 | B2 * | 8/2012 | Jangili | F01D 25/30 181/222 |

FOREIGN PATENT DOCUMENTS

| | | | | |
|---|---|---|---|---|
| DE | 19509616 A1 * | 9/1996 | | F23J 13/00 |

* cited by examiner

*Primary Examiner* — Jeremy A Luks
(74) *Attorney, Agent, or Firm* — Shackelford, Bowen, McKinley & Norton, LLP

(57) ABSTRACT

A sound level reducing apparatus and method for reducing the outdoor sound level produced by a high efficiency gas furnace. The apparatus comprising a muffler having an internal length determined by an identified target pure tone frequency producing an undesirable sound level. The internal length may be optimized to reduce the sound level across a range of operational frequencies.

8 Claims, 9 Drawing Sheets

APPARATUS AND METHOD FOR SOUND REDUCTION OF HIGH EFFICIENCY FURNACES

TECHNICAL FIELD

The present invention relates generally to heating, ventilation, and air conditioning ("HVAC") systems and, more particularly, but not by way of limitation, to reducing outdoor sound levels of high efficiency condensing furnaces.

HISTORY OF RELATED ART

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). For example, a furnace, such as a gas or electric furnace may be used to heat the air. High efficiency gas furnaces (e.g., 90% efficiency furnaces) rely on, for example, a combustion air inducer, to create controlled mass flow through a flue side of an appliance heat exchanger. The combustion air inducers used in high efficiency furnaces present a noise problem as they produce undesirable sound levels at a particular frequency when compared to lower efficiency furnaces.

SUMMARY OF THE INVENTION

An example muffler for a high efficiency gas furnace includes a first end cap connected to a shell, a second end cap connected to the shell, a first connecting pipe connected to the first end cap, a second connecting pipe connected to the second end cap, where the first connecting pipe is spaced a distance from the second connecting pipe, a tubular shaped wire mesh connected to the first connecting pipe and connected to the second connecting pipe, a tubular shaped insulation concentrically wrapped around and abutting the wire mesh, and wherein the distance is determined by a targeted frequency produced by the high efficiency gas furnace.

An example high efficiency gas furnace includes a heat exchange assembly connected to a burner assembly, a draft inducer assembly connected to the heat exchange assembly, a flue extending from the draft inducer assembly connected to a vertically oriented muffler, and wherein the muffler has a length determined by a targeted frequency produced by the draft inducer assembly.

An example method for reducing an outdoor sound level of a high efficiency gas furnace produced at a target pure tone frequency includes identifying the target pure tone frequency, calculating an interior length dimension of a muffler from the target pure tone frequency, and connecting the muffler having the calculated interior length dimension to a flue of the high efficiency gas furnace.

BRIEF DESCRIPTION OF THE DRAWINGS

A more complete understanding of embodiments of the present invention may be obtained by reference to the following Detailed Description when taken in conjunction with the accompanying Drawings wherein.

DETAILED DESCRIPTION OF ILLUSTRATIVE EMBODIMENTS

Figure 1A:
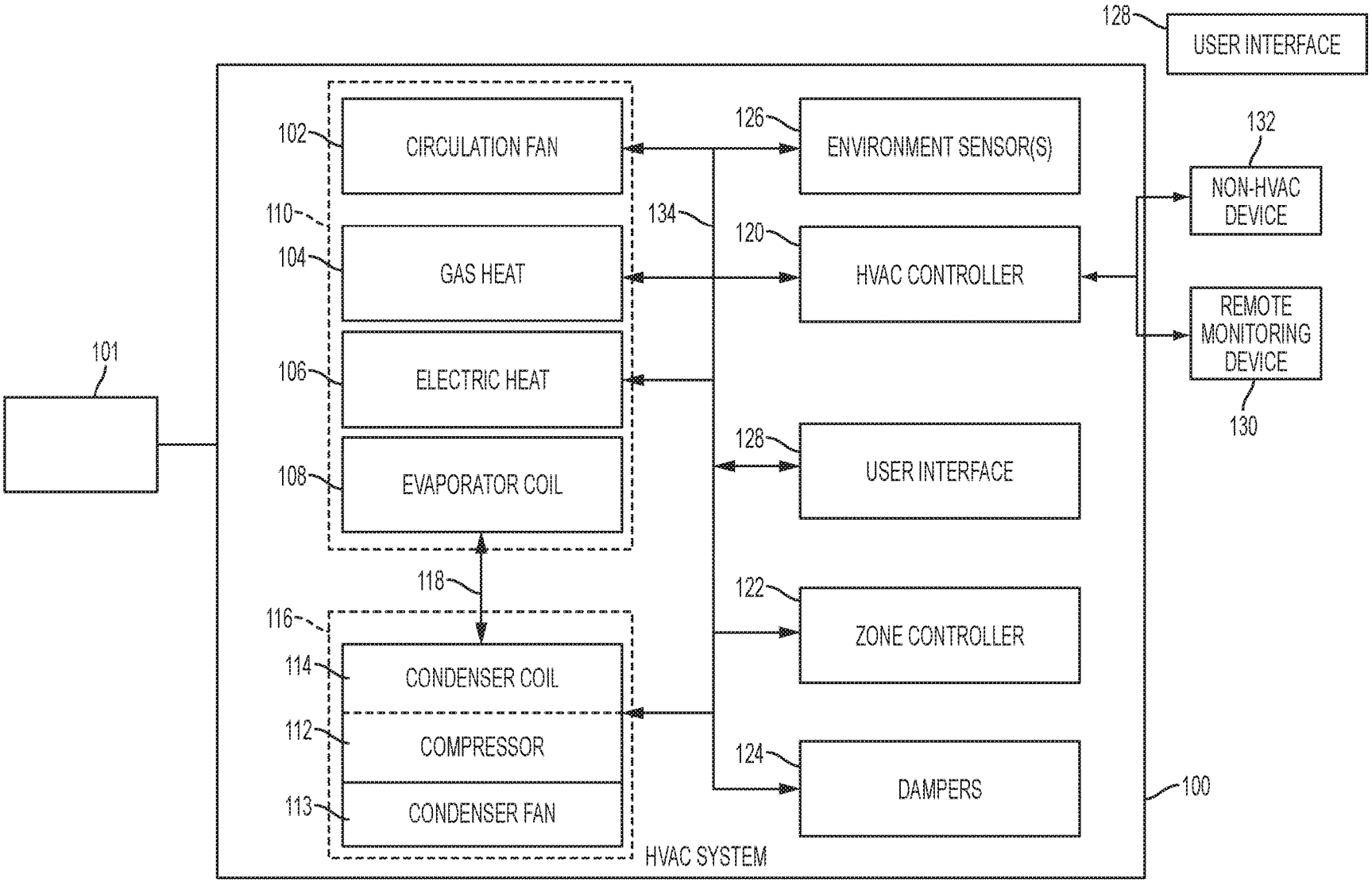
FIG. 1A is a block diagram of an illustrative HVAC system.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

FIG. 1A illustrates an HVAC system 100. In a typical embodiment, the HVAC system 100 is a networked HVAC system configured to condition air via, for example, heating, cooling, humidifying, or dehumidifying. The HVAC system 100 can be a residential system or a commercial system such as, for example, a roof top system. For illustration, the HVAC system 100 as illustrated in FIG. 1A includes various components; however, in other embodiments, the HVAC system 100 may include additional components that are not illustrated but typically included within HVAC systems.

The HVAC system 100 includes a circulation fan 102, a gas heat section 104, electric heat section 106, and a refrigerant evaporator coil 108 all typically associated with the circulation fan 102. The circulation fan 102, the gas heat section 104, the electric heat section 106, and the refrigerant evaporator coil 108 are collectively referred to as an "indoor unit" 110. In a typical embodiment, the circulation fan 102 may be a multi-speed or variable-speed circulation fan and the gas heat section 104 may be one or more stages or modulating heat output. In a typical embodiment, the indoor unit 110 is located within, or in close proximity to, an enclosed space 101. The HVAC system 100 also includes a compressor 112, an associated condenser coil 114, and a condenser fan 113, which are typically referred to as an "outdoor unit" 116. In a typical embodiment, the condenser fan 113 may be at least one of a fixed-speed condenser fan, a multi-speed condenser fan, or a variable-speed condenser fan. In some embodiments, the HVAC system 100 includes a reversing valve (not illustrated) to allow operation in a compressor heating mode. In various embodiments, the outdoor unit 116 is, for example, a rooftop unit or a ground-level unit. The compressor 112 and the associated condenser coil 114 are connected to an associated evaporator coil 108 by a refrigerant line 118. In a typical embodiment, the compressor 112 is, for example, a single-stage compressor, a multi-stage compressor, or a variable-speed compressor. The circulation fan 102, sometimes referred to as a blower, is configured to operate at different capacities (i.e., variable motor speeds) to circulate air through the HVAC system 100, whereby the circulated air is conditioned and supplied to the enclosed space 101.

The HVAC system 100 includes an HVAC controller 120 that is configured to control operation of the various components of the HVAC system 100 such as, for example, the circulation fan 102, the gas heat section 104, the electric heat section 106, the compressor 112, and the condenser fan 113. In some embodiments, the HVAC system 100 can be a zoned system. In such embodiments, the HVAC system 100 includes a zone controller 122, dampers 124, and a plurality of environment sensors 126. The plurality of environment sensors 126 may be, for example, outside air temperature ("OAT") sensors that are configured to measure outdoor air temperature, discharge air temperature ("DAT") sensors that are configured to measure HVAC air-duct discharge air temperature, indoor air temperature ("IAT") sensors (e.g., room temperature sensors), and the like. In a typical embodiment, the HVAC controller 120 cooperates with the zone controller 122 and the dampers 124 to regulate the environment of the enclosed space 101.

The HVAC controller 120 may be an integrated controller or a distributed controller that directs operation of the HVAC system 100. In a typical embodiment, the HVAC controller 120 includes an interface to receive, for example, thermostat demands, component health data, temperature setpoints, blower control signals, environmental conditions, and operating mode status for various zones of the HVAC system 100. In a typical embodiment, the HVAC controller 120 also includes a processor and a memory to direct operation of the HVAC system 100 including, for example, a speed of the circulation fan 102.

Still referring to FIG. 1A, in some embodiments, the plurality of environment sensors 126 are associated with the HVAC controller 120 and also optionally associated with a user interface 128. In some embodiments, the user interface 128 provides additional functions such as, for example, operational, diagnostic, status message display, and a visual interface that allows at least one of an installer, a user, a support entity, and a service provider to perform actions with respect to the HVAC system 100. In some embodiments, the user interface 128 is, for example, a thermostat of the HVAC system 100. In other embodiments, the user interface 128 is associated with at least one sensor of the plurality of environment sensors 126 to determine the environmental condition information and communicate that information to the user. The user interface 128 may also include a display, buttons, a microphone, a speaker, or other components to communicate with the user. Additionally, the user interface 128 may include a processor and memory that is configured to receive user-determined parameters, and calculate operational parameters of the HVAC system 100 as disclosed herein.

In a typical embodiment, the HVAC system 100 is configured to communicate with a plurality of devices such as, for example, a monitoring device 130, a communication device 132, and the like. In a typical embodiment, the monitoring device 130 is not part of the HVAC system. For example, the monitoring device 130 is a server or computer of a third party such as, for example, a manufacturer, a support entity, a service provider, and the like. In other embodiments, the monitoring device 130 is located at an office of, for example, the manufacturer, the support entity, the service provider, and the like.

In a typical embodiment, the communication device 132 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 132 includes at least one processor, memory and a user interface, such as a display. One skilled in the art will also understand that the communication device 132 disclosed herein includes other components that are typically included in such devices including, for example, a power supply, a communications interface, and the like.

The zone controller 122 is configured to manage movement of conditioned air to designated zones of the enclosed space. The zone-controlled HVAC system 100 allows the user to independently control the temperature in the designated zones. In a typical embodiment, the zone controller 122 operates the dampers 124 to control air flow to the zones of the enclosed space.

In some embodiments, a data bus 134, which in the illustrated embodiment is a serial bus, couples various components of the HVAC system 100 together such that data is communicated therebetween. In a typical embodiment, the data bus 134 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 134 may include an Accelerated Graphics Port ("AGP") or other graphics bus, a Controller Area Network ("CAN") bus, a front-side bus ("FSB"), a HYPERTRANSPORT ("HT") interconnect, an INFINIBAND interconnect, a low-pin-count ("LPC") bus, a memory bus, a Micro Channel Architecture ("MCA") bus, a Peripheral Component Interconnect ("PCI") bus, a PCI-Express ("PCI-X") bus, a serial advanced technology attachment ("SATA") bus, a Video Electronics Standards Association local ("VLB") bus, or any other suitable bus or a combination of two or more of these. In various embodiments, the data bus 134 may include any number, type, or configuration of data buses 134, where appropriate. In particular embodiments, one or more data buses 134 (which may each include an address bus and a data bus) may couple the HVAC controller 120 to other components of the HVAC system 100. In other embodiments, connections between various components of the HVAC system 100 are wired. For example, conventional cable and contacts may be used to couple the HVAC controller 120 to the various components.

In some embodiments, a wireless connection is employed to provide at least some of the connections between components of the HVAC system such as, for example, a connection between the HVAC controller 120 and the circulation fan 102 or the plurality of environment sensors 126.

Figure 1B:
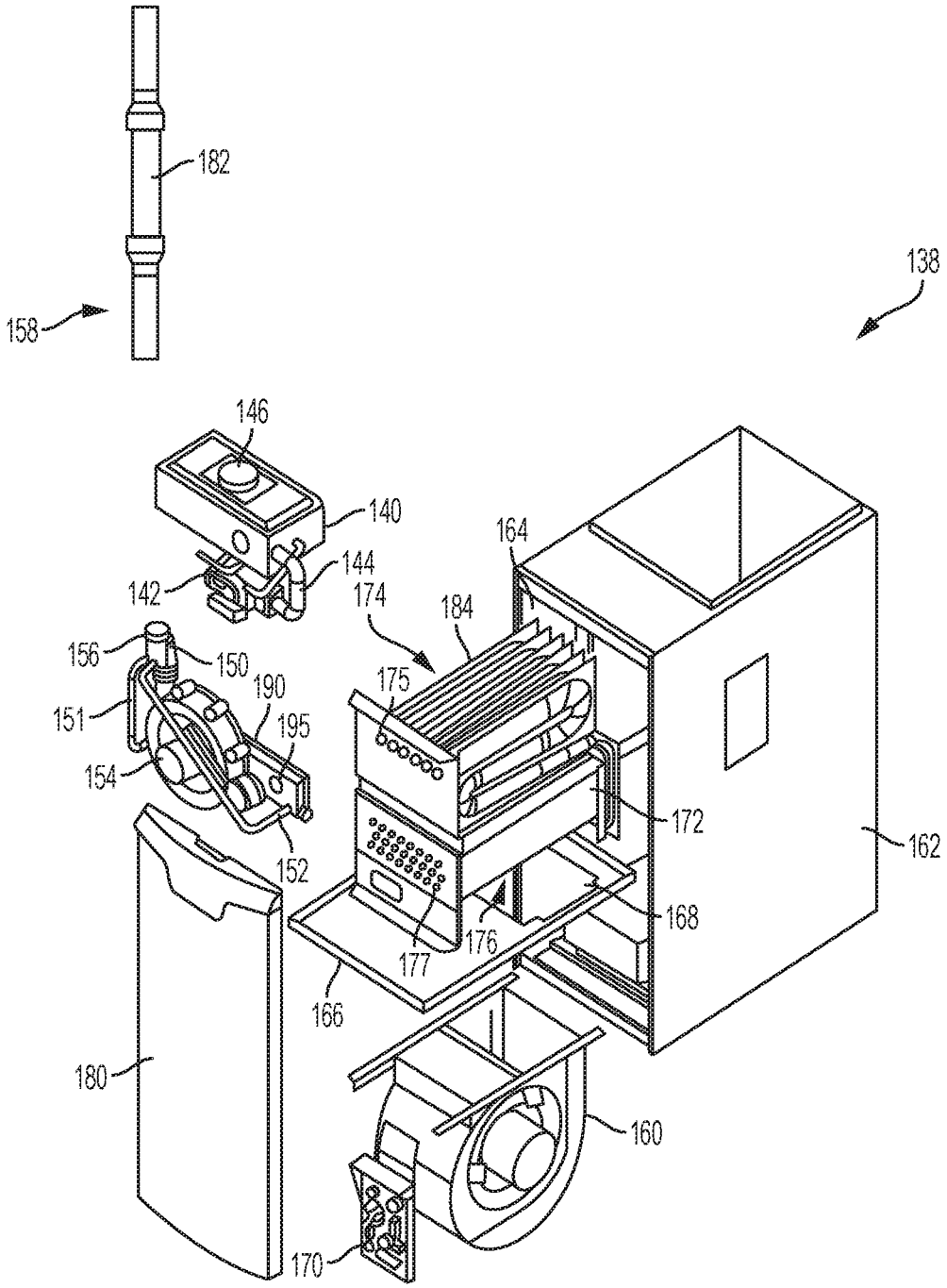
FIG. 1B is an exploded perspective view of a portion of a furnace according to one or more aspects of the disclosure.

FIG. 1B, is an exploded perspective view of a portion of a furnace 138 constructed according to the principles of the disclosure. The furnace 138 may be a multi-position furnace. In some embodiments, the furnace may be a residential or commercial gas furnace. The furnace 138 includes a housing 162 having a front opening 164 within which a mounting shelf 166 is located. The mounting shelf 166 has an opening 168 therein and supports a heat exchanger assembly 172 over the opening 168. The heat exchanger assembly 172 includes a primary heat exchanger 174 and a secondary heat exchanger 176. The primary heat exchanger 174 includes a row of six heat exchangers (one referenced as 184) coupled to one another. The heat exchangers are generally serpentine shaped and have a plurality of approximately 180° folds such that the heat exchangers cross over the opening 168 a plurality of times, terminating in inlets 175 (of the primary heat exchanger 174) and outlets 177 (of the secondary heat exchanger 176) that are generally mutually coplanar and oriented toward the opening 164 of the housing 162. Alternative embodiments of the heat exchanger assembly 172 may have more or fewer heat exchangers coupled to one another in one or more rows. Additionally, alternative embodiments may have alternative heat exchanger configurations.

A burner assembly 140 contains a thermostatically-controlled solenoid valve 142, a manifold 144 leading from the thermostatically-controlled solenoid valve 142 and across the burner assembly 140, one or more gas orifices coupled to the manifold 144 and one or more burners corresponding to and located proximate the gas orifices. The illustrated embodiment of the burner assembly 140 has a row of six burners. Alternative embodiments of the burner assembly 140 may have more or fewer burners arranged in one or more rows. A combustion air inlet 146 allows air in for the burner assembly 140. In an assembled configuration, the burner assembly 140 is located proximate the heat exchanger assembly 172 such that the burners thereof at least substantially align with the inlets 175.

The furnace 138 also includes a draft inducer assembly 150 having a combustion air inducer 154 and a combustion flue collar 156 coupled to an outlet of the combustion air inducer 154. In an assembled configuration, the draft inducer assembly 150 is located proximate the heat exchanger assembly 172 such that the combustion flue collar 156 substantially aligns with a flue 158 that directs undesired gases (e.g., gaseous products of combustion) away from the furnace 138. Associated with the draft inducer assembly 150 are first and second drain hoses, 151, 152 that provide a path to drain condensation from the combustion flue collar 156 and the flue 158. Interrupting and attached to the flue 158 is a muffler 182 that reduces the outdoor sound of the furnace at a pure tone frequency of the combustion air inducer 154. A pure tone is a tone with a sinusoidal waveform. e.g. a sine or cosine wave. This means that regardless of other characteristic properties such as amplitude or phase, the wave consists of a single frequency. The muffler 182 may be sized specifically to reduce the outdoor sound of a pure tone frequency of a combustion air inducer of a high efficiency gas furnace. The muffler 182 is vertically oriented in a vertical section of the flue 158. As the flue 158 exits the draft inducer assembly 150, the muffler 182 interrupts the flue 158 at a position at least approximately twelve inches from where the flue 158 exits the furnace 138.

A blower 160 is suspended from the mounting shelf 166 such that an outlet thereof approximately aligns with the opening 168. An electronic controller 170 is located proximate the blower 160 and is configured to control at least one of the blower 160, the valve 142, and the combustion air inducer 154 to cause the furnace 138 to provide heat. A cover 180 may be placed over the front opening 164 of the housing 162.

A cold end header box ("CEHB") 190 provides an interface between the combustion air inducer 154 and the secondary heat exchanger 176. The combustion air inducer 154 has an inlet coupled to the CEHB 190. In an assembled configuration, the draft inducer assembly 150 is located proximate the heat exchanger assembly 172 such that the CEHB 190 substantially aligns with the outlets 177 and the combustion flue collar 156 substantially aligns with the flue 158.

The furnace 138 also includes a pressure sensing device 195 that is configured to monitor the combustion pressure through the furnace 138. In a typical embodiment, the pressure sensing device 195 may be a mechanical differential pressure sensing device, such as, for example, a pressure switch or an electronic sensor which provide feedback to an integrated electronic controller of the furnace 138, such as, for example, the electronic controller 170. The pressure sensing device 195 includes inputs for determining the combustion pressure. The inputs of the pressure sensing device 195 are coupled to pressure ports of the CEHB 190.

Based on a differential pressure obtained by the pressure sensing device 195 from data received via the pressure ports, the gas supply for the heat exchanger 172 may be turned-off or remain off when there is improper air flow through the heat train. Additionally, the gas supply for the heat exchanger 172 may be turned-off or remain off when condensation drainage of the CEHB 190 is impaired or blocked. Thus, the same pressure sensing device 195 employing data from the pressure ports of the CEHB 190 may protect the furnace 138 from improper air flow through the heat train and protect the furnace 138 from blocked condensation drainage originating in the flue 158. The pressure sensing device 195 may be fastened to the ports of the CEHB 190 through conventional hoses. The pressure sensing device 195 may also be coupled to the electronic controller 170 or the valve 142 through conventional means. In some embodiments, the pressure sensing device 195 may be fastened to the CEHB 190.

In the illustrated embodiment, the controller 170 turns on the combustion air inducer 154 to initiate a draft in the heat exchangers (including the heat exchanger 172) and purge potentially harmful unburned or combustion gases. Then the controller 170 opens the valve 142 to admit gas to the manifold 144 and the one or more gas orifices, whereupon the gas begins to mix with air to form primary combustion air. Then the controller 170 activates an igniter to attempt to ignite the primary combustion air. If the output of a flame rectification circuit indicates that the primary combustion air has not ignited within a predetermined period of time, the controller 170 then closes the valve 142 and waits until attempting to start again. If the output of a flame rectification circuit indicates that the primary combustion air has ignited within the predetermined period of time, the controller 170 then activates the blower 160, which forces air upward through the opening 168 and the heat exchanger assembly 172. As the air passes over the surfaces of the heat exchangers, the air is warmed, whereupon it may be delivered or distributed as needed to provide heating.

Figure 2A:
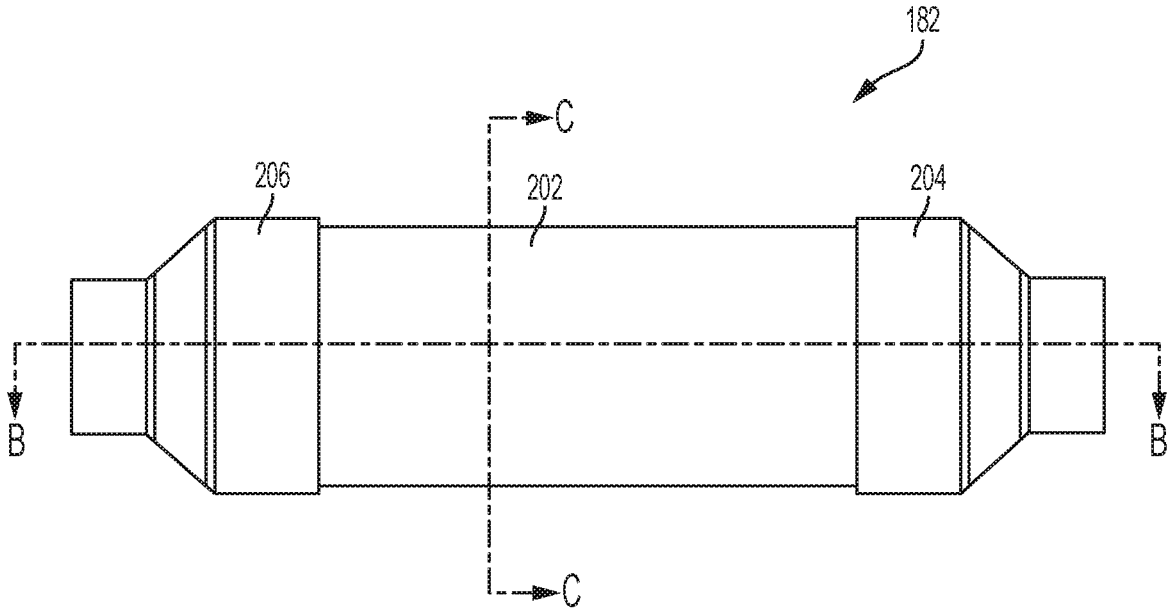
FIG. 2A is a side view of a muffler according to one or more aspects of the disclosure.
Figure 2B:
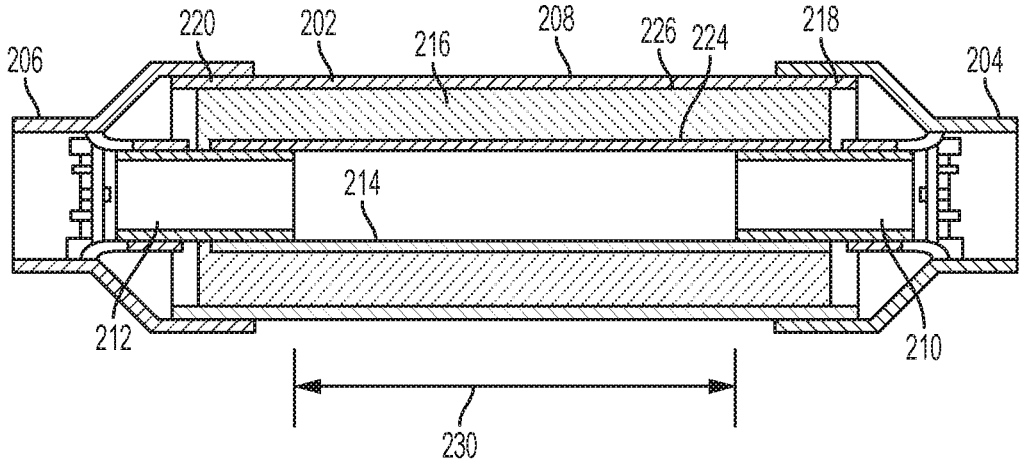
FIG. 2B is a sectional side view of the muffler according to one or more aspects of the disclosure taken along line B-B of FIG. 2A.
Figure 2C:
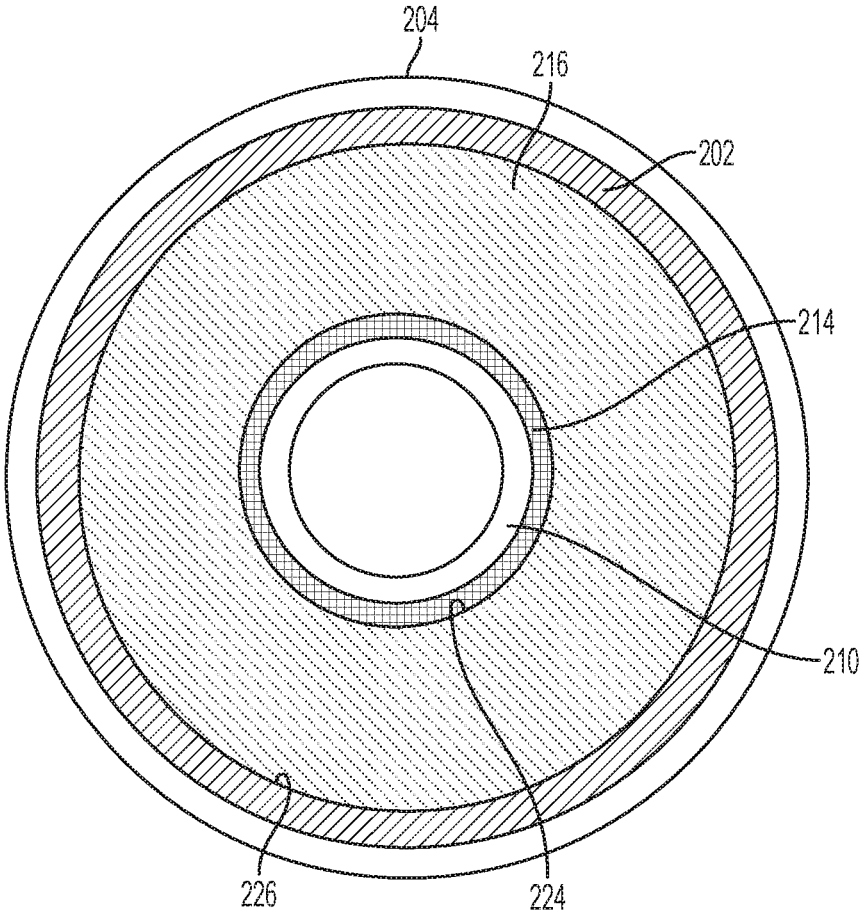
FIG. 2C is a sectional end view of the muffler according to one or more aspects of the disclosure taken along line C-C of FIG. 2A.

Referring to FIGS. 2A-2C, the muffler 182 includes shell 202 attached to end caps 204, 206. The shell 202 is a hollow cylinder having an outer diameter of approximately 4.5 inches and an inner diameter of approximately 4 inches. The shell 202 has an outer surface 208. In a typical embodiment, the shell 202 has a length extending between a first end 218 and a second end 220 in the range of approximately 10 to 14 inches. A first connecting pipe 210 and a second connecting pipe 212 are attached to end caps 204, 206, respectively. First connecting pipe 210 extends from the end cap 204 to the interior of the shell 202. Second connecting pipe 212 extends from the end cap 206 to the interior of the shell 202. A distance 230 is the distance between first and second connecting pipes 210, 212. The distance 230 determines the minimum length of the muffler 182 in whole. The shell 202, the end caps 204 and 206, and the first and second connecting pipes 210, 212 are manufactured of schedule 40 Polyvinyl Chloride ("PVC") and meet ASTM Specification D1784. All connections between PVC parts are primed with adhered with PVC primer and solvent cement per ASTM D2564 in accordance with industry practices and standards. All connections are gas tight to prevent leakage of combustion products into living space.

A wire mesh 214, formed in a tubular shape, is concentrically wrapped around both the first and second connecting pipes 210, 212. Wire mesh 214 overlaps each connecting pipe in the range of approximately 0.5 to 1.5 inches. Insulation 216 is one inch thick with a density of 1.5 lbs/ft$^3$ fiberglass sheet formed in a tubular shape and wrapped concentrically around wire mesh 214. Insulation 216 has a length in the range of approximately 8 to 12 inches. The length of insulation 216 should be sufficient to completely encompass the length of wire mesh 214. Inner surface 224 of insulation 216 abuts wire mesh 214. Outer surface 226 of insulation 216 may expand to abut shell 202.

In an assembled configuration, both the end caps 204, 206 are further attached to separated ends of the flue 158. The muffler 182 is generally symmetrical both longitudinally and laterally. Either end cap 204 and 206 can function as an inlet to the muffler. When the end cap 204 performs as an inlet to the muffler 182, the end cap 206 functions as an outlet from the muffler 182. When the end cap 204 functions as an inlet to the muffler 182, the end cap 206 functions as an outlet from the muffler 182. The muffler 182 is oriented vertically within a vertical section of the flue 158 (FIG. 1B).

A sound is characterized as a periodic vibration. The frequency of a sound is the number of vibrations per second. The frequency of a sound increases as the number of vibrations per second increase. The unit of sound frequency is the hertz ("Hz"). The generally accepted standard range of sound frequencies audible to the average human is 20 to 20,000 Hz. Sound levels can be measured at each frequency. Decibels ("dB") is the measurement of the level of sound at each frequency. A higher decibel level indicates a louder sound or noise detected at the frequency.

Combustion air inducers (having, for example, four impeller blades) of high efficiency furnaces often operate at, but are not limited to, a pure tone frequency in the range of approximately 615 to 630 Hz. The resulting decibel level at the pure tone frequency has been found to be especially undesirable. High efficiency gas furnaces without mufflers have been measured at upwards of 60 decibels during operation.

The distance 230 of the muffler 182 is determined in response to reducing the measured sound level at a particular targeted sound frequency, for example, the pure tone frequency of the combustion air inducer 154. The distance 230 is calculated by dividing the speed of sound by the target frequency of the combustion air inducer 154 and dividing the result by the number of impeller blades in the combustion air inducer 154 of the furnace 138. A conversion factor may be used to convert length units. Although sound levels over a wide range of frequencies are reduced by the muffler, the greatest percentage of sound level reduction will occur at the targeted frequency. Therefore, when given the target frequency in Hz and the speed of sound in ft/sec, the distance 230 in inches can be calculated according to the following formula of Eq. 1:

$$\text{Distance 230 (inches)} = \frac{\text{Speed of Sound}\left(1{,}128\frac{\text{ft}}{\text{sec}}\right)}{\text{Given Target Freq(Hz)}} * \frac{\text{Conversion Factor(12 in/ft)}}{\text{Number of Inducer Blades (4)}} \qquad \text{Eq. 1}$$

For example, for a frequency of 630 Hz, the distance 230 is approximately 5.4 inches. The muffler 182 is constructed with a specific distance 230 directed to reduce the sound level at a specific target frequency. Through iterations in a sound lab, the muffler 182 may be constructed such that distance 230 corresponds to a length that optimizes sound level reduction across all operational frequencies of the furnace 138. As a result, distance 230 may have a length in the range of approximately 5 to 9 inches.

Figure 3A:
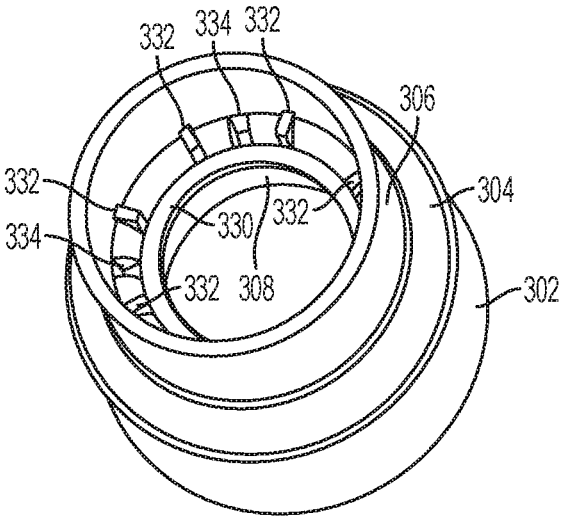
FIG. 3A is a perspective view of an end cap according to one or more aspects of the disclosure.
Figure 3B:
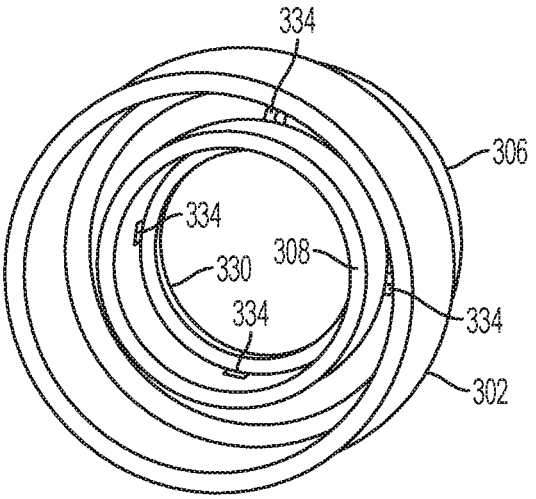
FIG. 3B is a perspective view of the end cap according to one or more aspects of the disclosure.
Figure 3C:
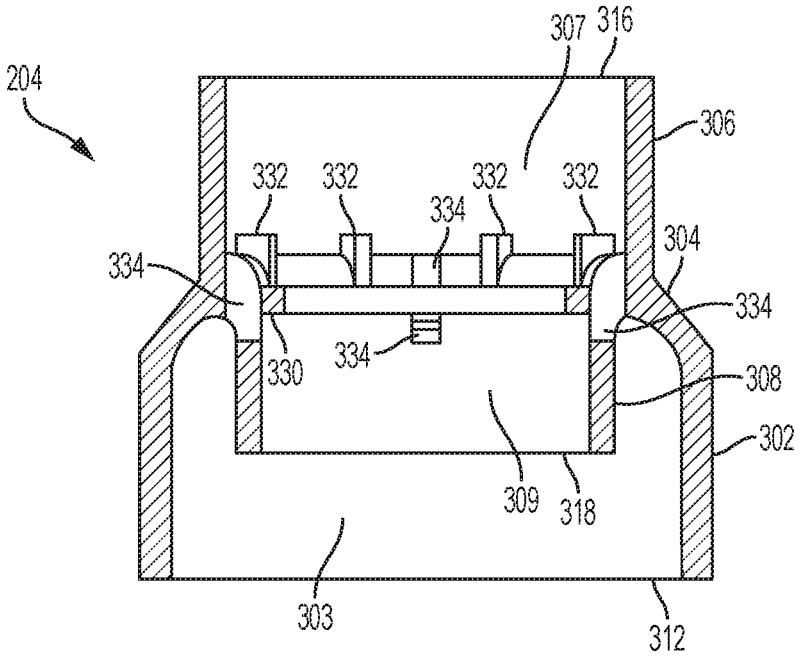
FIG. 3C is a sectional side view of the end cap according to one or more aspects of the disclosure.

Referring to FIGS. 3A-3C, the end caps 204, 206 are generally tubular having, for example, a frustoconical midsection. In the interest of clarity, a single end cap is described herein with the understanding that the muffler 182 comprises a pair of identical end caps 204, 206. Each end cap includes an inner section 302, a midsection 304, and an outer section 306. The inner section 302 defines an opening 312 that leads to an interior 303. The opening 312 is sized to frictionally engage outer surface 208 of the shell 202. The inner section 302 is integrally formed with the midsection 304. The midsection section 304 further includes an integrally formed interior section 308. The interior section 308 is generally tubular and defines an opening 318 that leads to an interior 309. The opening 318 is sized to frictionally engage the first and second connecting pipes 210, 212. The outer section 306 defines an opening 316 that leads to an interior 307. The opening 316 is sized to frictionally engage the flue 158. The outer section 306 is integrally formed with the midsection 304.

An annular ring 330 extends inward from the midsection 304 between the interiors 307, 309. Ribs 332 extend from the midsection 304 into the interior 307. The ribs 332 are equally spaced around the annular ring 330. Drain holes 334 are spaced equally between the ribs 322 around the annular ring 330. The drain holes 334 allow passage of condensation from the interiors 303, 309 to the interior 307 down to the flue 158. Condensation may form in the flue above the muffler and within the muffler. Drain holes 334 allow the condensation to drain down through the muffler 182 into the flue 158 below the muffler 182.

The muffler 182 can be installed on the flue of high efficiency gas furnaces having a flue with a diameter in the range of approximately 2 to 3 inches, commonly referred to as 2 inch or 3 inch vent systems. Opening 316 is sized to frictionally engage a flue having a 2 inch diameter. In the case of a 3 inch flue, either an adapter fitted to the end cap at the opening 316 would be employed, or 3 inch end caps 204, 206, wire mesh 214, and first and second connecting pipes 210, 212 would be used depending on vent length and proximity of the muffler 182 to the furnace 138.

Figure 4A:
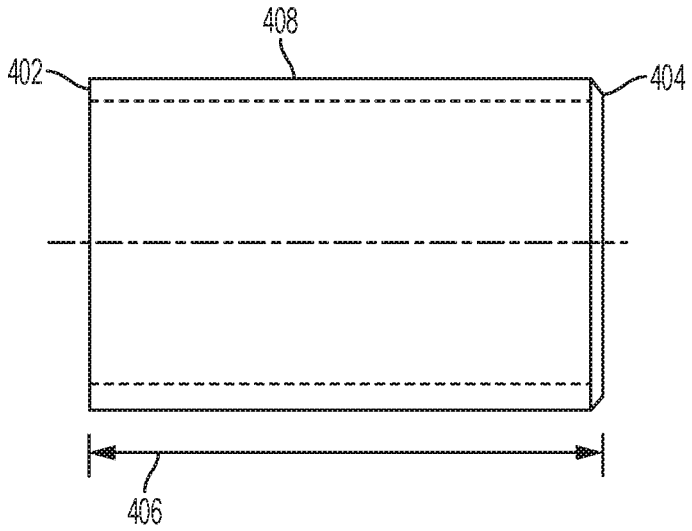
FIG. 4A is a side view of a connector pipe according to one or more aspects of the disclosure.
Figure 4B:
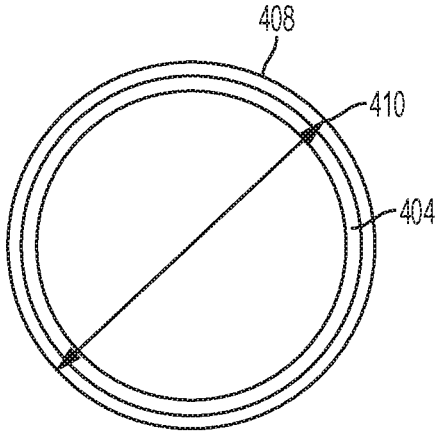
FIG. 4B is an end view of the connector pipe according to one or more aspects of the disclosure.

Referring to FIGS. 4A-4B, first and second connecting pipes 210, 212 are generally tubular. In the interest of clarity, a single connecting pipe is described herein with the understanding that muffler 182 comprises a pair of identical first and second connecting pipes 210, 212. Each connecting pipe includes an end 402 and a chamfered end 404. A length 406 of the connecting pipe extends between the end 402 and the chamfered end 404. The length 406 is in the range of approximately 2.5 to 3.5 inches. Each connecting pipe has an outer surface 408 with a diameter 410. The diameter 410 is approximately 2 inches. The outer surface 408 is sized to frictionally engage the interior section 308 through the opening 318. The chamfered end 404 eases insertion of the connecting pipe into engagement with the interior section 308 of the end cap. The distance 230 is the distance between the end 402 of the first connecting pipe 210 and the end 402 of the second connecting pipe 212.

Figure 5A:
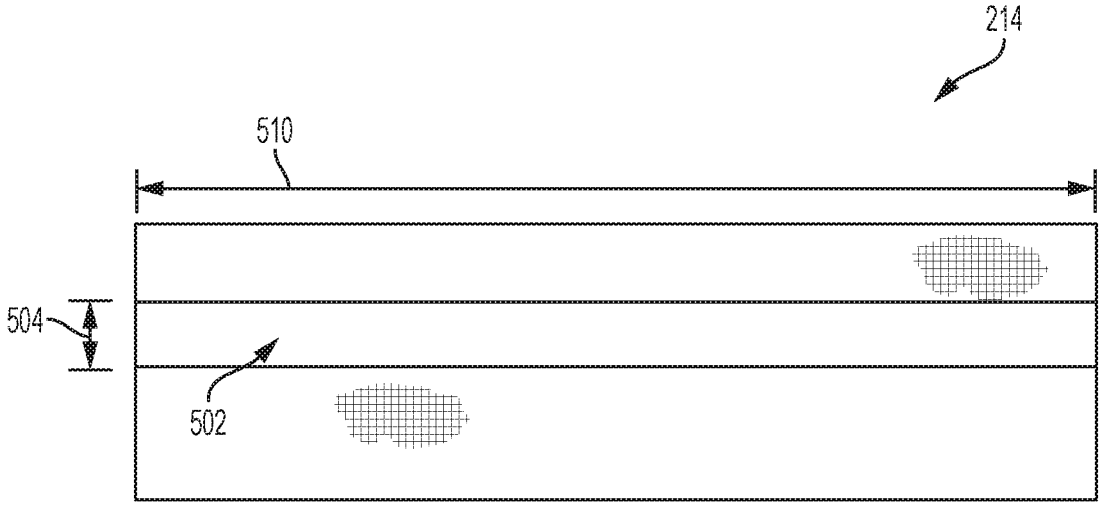
FIG. 5A is a side view of a wire mesh tube according to one or more aspects of the disclosure.
Figure 5B:
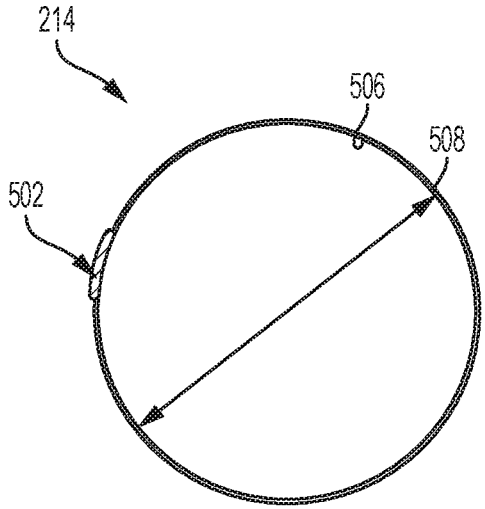
FIG. 5B is an end view of the wire mesh tube according to one or more aspects of the disclosure.

Referring to FIGS. 5A-5B, the wire mesh 214 is a stainless steel wire mesh having 0.028 inch wire width forming 0.097 inch square weave openings. The wire mesh 214 has 8 wires per inch and meets ASTM E 2016-11 specification for industrial woven wire cloth. The wire mesh 214 is typically a flat sheet welded into a tubular shape having an overlap section 502 extending along its length. The overlap section 502 has a height 504 in the range of approximately 0.5 to 1.5 inches. The tubular shaped wire mesh 214 is wrapped concentrically around the end 402 of each connecting pipe. An inner surface 506 of the tubular shaped wire mesh 214 abuts the outer surface 408 of both first and second connecting pipes. The inner surface 506 has a diameter 508 of approximately 2 inches. The wire mesh 214 has a length 510 in the range of approximately 7 to 12 inches. The length of the wire mesh 214 should be sufficient to overlap the end 402 of the first and second connecting pipes 210, 212 in the range of approximately 0.5 to 1.5 inches while ensuring the distance 230 between the first and second connecting pipes 210, 212.

Figure 6:
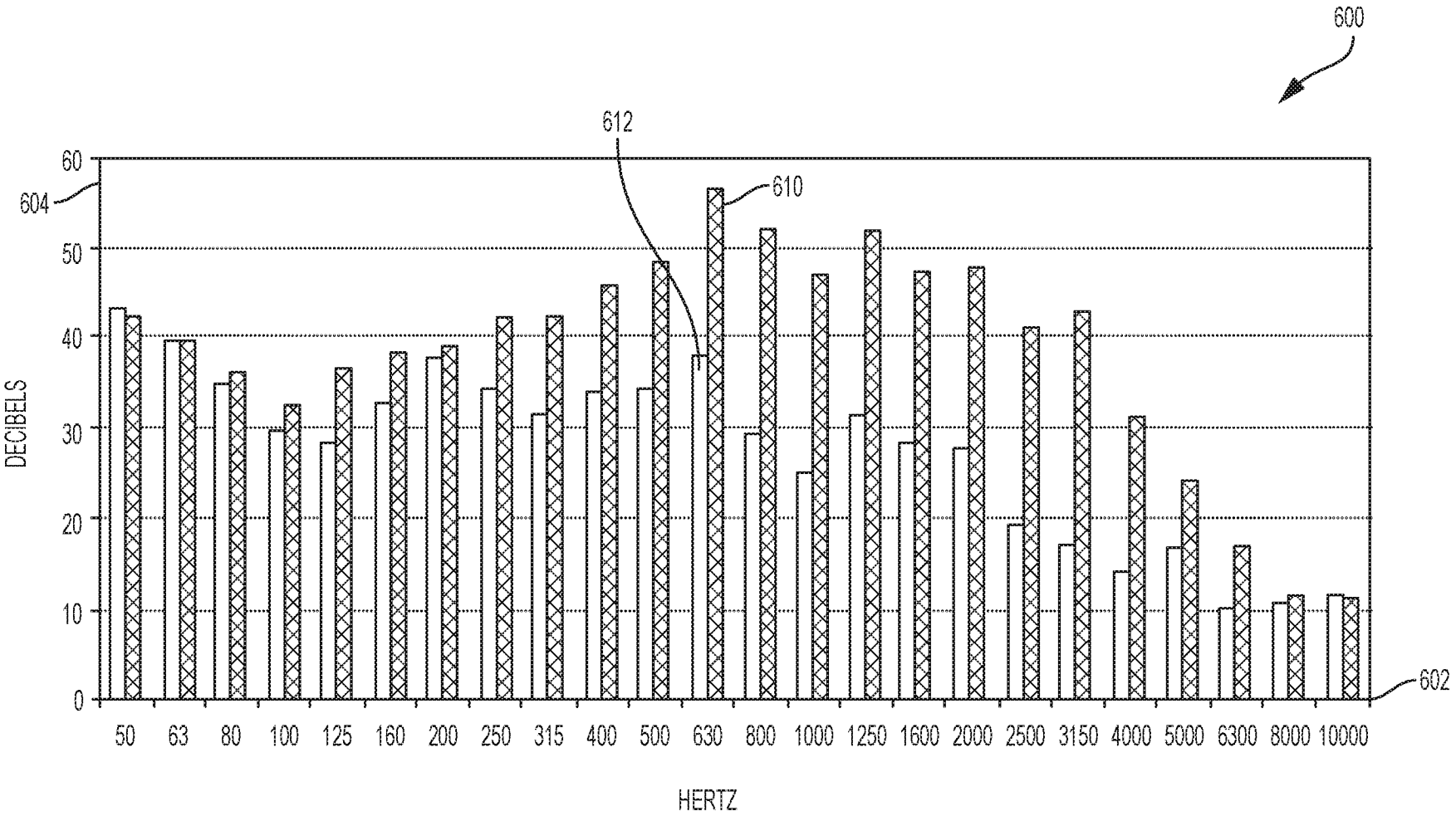
FIG. 6 is a bar graph illustrating decibel levels over a range of frequencies during operation of a furnace with and without a muffler according to one or more aspects of the disclosure.

Referring to FIG. 6, bar graph 600 illustrates how the muffler 182, having a distance 230 of approximately 9 inches, reduces the sound level of the furnace 138 across a range of frequencies. The X-axis 602 represents a range of sound frequencies (in Hz) of the furnace 138 during operation. The Y-axis 604 depicts a measured sound/noise level (in dB) at each frequency. The rightmost column 610 of each bar depicts the measured sound level of the furnace at a particular frequency without the muffler 182 installed on the flue. The leftmost column 612 of each bar depicts the measured sound level of the furnace at the same frequency with the muffler 182 installed. For example, at a frequency of 630 Hz, the column 610 is approximately 58 dB. At the same frequency of 630 Hz, the column 612 is approximately 38 dB. The muffler 182 installed on the furnace 138 reduces the sound level of the furnace 138 at the pure tone of 630 Hz by approximately 20 dB or approximately 34%.

In operation, sound vibrations from the furnace are transmitted through the flue. The sound vibrations enter the muffler and vibrate the wire mesh. The insulation surrounding the wire mesh absorbs the vibrations thus reducing the vibrations exiting the muffler and thus reducing the sound level exiting the muffler. Sound levels over a wide range of frequencies are reduced by the muffler. The most directed sound level reduction will occur at the targeted frequency for which the muffler was constructed. The targeted frequency determines the distance 230 of the muffler.

Figure 7:
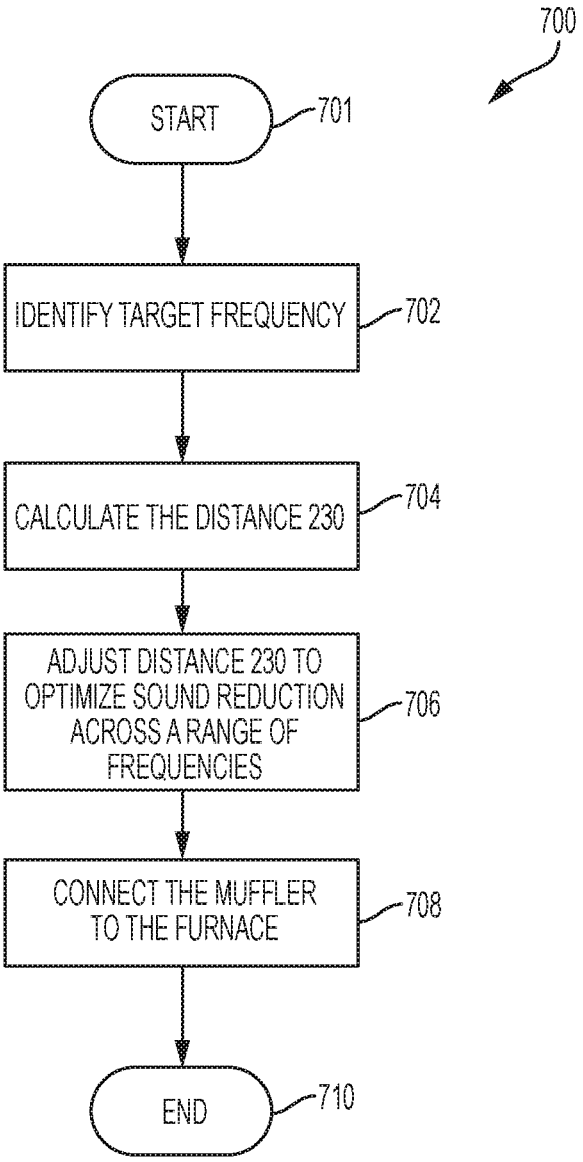
FIG. 7 is a flowchart illustrating a process for reducing an outdoor sound level of a high efficiency gas furnace produced at a target pure tone frequency according to one or more aspects of the disclosure.

Referring to FIG. 7, the process 700 performed to reduce the outdoor sound level of a high efficiency gas furnace is shown. The process 700 starts at step 701. At step 702, a target frequency of an offending sound from the high efficiency gas furnace is identified and measured. The frequency of sounds can be measured in Hz, for example, with an oscilloscope. At step 704, the distance 230 between the first and second connecting pipes 210, 212 for the muffler 182 is calculated using Eq. 1. The muffler is built such that the distance 230 is the calculated distance based on the targeted frequency of the offending sound, for example the pure tone frequency of the combustion air inducer impeller blades. At step 706, through iterations in a sound lab, distance 230 may be adjusted to optimize sound reduction across a range of operational frequencies. At step 708, the muffler is connected to the flue of the high efficiency gas furnace. The muffler is installed on a vertical section of the flue at a minimum of twelve inches from the high efficiency gas furnace. Such an arrangement reduces the outdoor sound level of a high efficiency gas furnace. At step 710, the process 700 ends.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the processor, one or more portions of the system memory, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

In any disclosed embodiment, the terms "substantially." "approximately." "generally." and "about" may be substituted with "within [a percentage] of" what is specified, where the percentage includes 0.1, 1, 5, and 10 percent.

Conditional language used herein, such as, among others, "can." "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

Although various embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A high efficiency gas furnace, comprising: a heat exchange assembly connected to a burner assembly; a draft inducer assembly connected to the heat exchange assembly; a flue extending from the draft inducer assembly connected to a vertically oriented muffler; wherein the muffler further comprises: a first end cap connected to a shell; a second end cap connected to the shell; a first connecting pipe connected to the first end cap; a second connecting pipe connected to the second end cap, where the first connecting pipe is spaced a distance from the second connecting pipe; a wire mesh connected to the first connecting pipe and connected to the second connecting pipe; insulation wrapped around and abutting the wire mesh; wherein the muffler has a length determined by a targeted frequency produced by the draft inducer assembly and wherein the distance is determined by the targeted frequency produced by the draft inducer assembly and the length is determined by the distance.

2. The muffler of claim 1, wherein the distance is calculated by dividing a speed of sound by the targeted frequency and further dividing by a number of impeller blades of the draft inducer assembly.

3. The gas furnace of claim 1, wherein the first connecting pipe further comprises:

a first end opposite a chamfered end; and wherein the first end engages the wire mesh and the chamfered end engages the first end cap.

4. The gas furnace of claim 1, wherein the first end cap further comprises:

an inner section connected to the shell;

a frustoconically shaped midsection integrally formed with the inner section; and an outer section integrally formed with the midsection.

5. The gas furnace of claim 1, wherein the first end cap further comprises:

an inner section integrally formed with a midsection; and an interior section, extending from the midsection within the inner section, connected to the first connecting pipe.

6. The gas furnace of claim 1, wherein the first end cap further comprises:

an interior section connected to the first connecting pipe; and drain holes spaced equally around the interior section.

7. The gas furnace of claim 1, wherein the first end cap further comprises:

an inner section connected to the shell;

a midsection connected to the inner section;

an interior section connected to the midsection and connected to the first connecting pipe; and an outer section connected to the midsection.

8. The gas furnace of claim 1, further comprising:

the wire mesh formed into a tubular shape having a first length;

the insulation formed into a tubular shape concentrically wrapped around the wire mesh and having a second length; and wherein the second length is greater than the first length.

* * * * *